US007693464B2

(12) United States Patent
Farris et al.

(10) Patent No.: US 7,693,464 B2
(45) Date of Patent: Apr. 6, 2010

(54) STABILIZER FOR A TONER CARTRIDGE AND RELATED METHOD

(75) Inventors: Howard C. Farris, Ravenna, KY (US); Abigail S. Marsh, Lexington, KY (US); Jerry W. Smith, Irvine, KY (US); James E. Dickerson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 303 days.

(21) Appl. No.: 11/788,555

(22) Filed: Apr. 20, 2007

(65) Prior Publication Data

US 2008/0260433 A1 Oct. 23, 2008

(51) Int. Cl.
*G03G 15/08* (2006.01)

(52) U.S. Cl. ..... 399/262; 399/110; 399/111; 399/258

(58) Field of Classification Search ..... 399/262
See application file for complete search history.

(56) References Cited

U.S. PATENT DOCUMENTS

| | | | | |
|---|---|---|---|---|
| 6,256,469 | B1 * | 7/2001 | Taniyama et al. | 399/258 |
| 2003/0228175 | A1 * | 12/2003 | Wang et al. | 399/258 |
| 2006/0067750 | A1 * | 3/2006 | Inoue et al. | 399/328 |
| 2006/0245784 | A1 * | 11/2006 | Tsuzuki et al. | 399/111 |

* cited by examiner

*Primary Examiner*—David M Gray
*Assistant Examiner*—Roy Yi

(57) ABSTRACT

A user-removable stabilizer for a toner cartridge assembly comprises of at least one member that becomes inserted in the toner cartridge assembly for capturing a first movable section of the toiler cartridge assembly and interconnecting at least the first movable section with a second movable section of the toner cartridge assembly, and a stopping member protruding upwardly from the at least one member for limiting insertion of the stabilizer into the toner cartridge assembly. A method of stabilizing movable sections of a toner cartridge assembly is also provided.

27 Claims, 10 Drawing Sheets

STABILIZER FOR A TONER CARTRIDGE AND RELATED METHOD

FIELD OF THE INVENTION

The present invention generally relates to the field of removable cartridge assemblies for electrophotographic image forming devices. More specifically, it relates to a stabilizer for interconnecting two movable sections of a toner cartridge assembly. A method for stabilizing movable sections of a toner cartridge assembly is also contemplated.

BACKGROUND OF THE INVENTION

Electrophotographic image forming devices ("EP devices"), such as photocopiers, laser printers, and facsimile machines, may employ the use of removable toner cartridge assemblies. Such cartridge assemblies are removable because the serviceable lifetime of certain cartridge components is often shorter than the serviceable lifetime of the EP device that the cartridge supplies. Cartridge assemblies for these image forming devices often include a photoconductive drum and a developer housing located adjacent to the photoconductive drum for the purpose of providing toner. The toner is often housed in a molded plastic reservoir. The cartridge assembly also may include a toner adder roller, a charge roller, a doctor blade, and a gear train that mates to a set of gears in the EP device. The gears are used, among other things, to drive the photoconductive drum in conjunction with the toner adder roller. A waste toner reservoir may also be attached to one side of the cartridge. Toner cartridges may be supplied to a user in a conventional all inclusive assembly or in a separable multi-part assembly.

In recent years, the size of the image forming device has become a significant issue. For instance, with regard to laser printers, demands of desk space in the digital office have dictated the reduction in size of the printers. Size restrictions, both in regard to desktop space, and in shipping costs have limited the overall size of the corresponding toner cartridge. For this reason, it has become advantageous to both manufacturer and user of the EP device in many cases to split apart the toner storage component of the cartridge from the image forming housing component of the cartridge. Generally, the image forming component of the cartridge contains the photoconductor drum, while the toner storage component of the cartridge contains the toner. These so called two-part toner cartridges provide the user a longer service life of key components of the cartridge, while limiting the space required for toner storage within the image forming device.

For larger office image forming systems, desktop space is not the issue. However, a two-part cartridge can still have various benefits. For instance, the photoconductive drum and toner can be separated, such that if the photoconductor drum section is damaged, toner may be spared. Likewise, if toner usage is great, the photoconductive drum may be used in more than one toner container cycle.

Cartridges of the two-part variety are used today to provide toner to both monochrome and color EP devices. For instance, in color laser printers, the number of cartridges is increased due to the additional toner requirements for producing the large array of colors needed in color image forming print jobs. For example, while monochrome laser printing requires a single cartridge of black toner, a color laser printer will require four cartridges such as a black, magenta, cyan, and yellow.

One problem sometimes encountered in two-piece cartridges relates to damage during shipping. Specifically, movement of the cartridge components during shipping can create cartridge failure. This failure is often associated with breakage of the cartridge housing and massive toner leakage. Such failure can ultimately deem the shipped cartridge unusable by the user. Obviously, this creates additional cost for the manufacturer relating to replacement of the damaged cartridge, as well as delay in delivering a usable cartridge to the user.

Several options have been contemplated for minimizing movement of components of the two-piece cartridge. One option relates to including additional packing material around the cartridge. However, packaging methods that add bulk, such as adding cushioning to the shipping material, are not desirable due to the significant added cost of the shipping material and the relatively insignificant improvement of such methods. Likewise, additional holding methods of conventional packaging materials such as cardboard, STYROFOAM blocks, plastic shipping trays, and the like, are not feasible due to their relative ineffectiveness in preventing movement and subsequent breaks in the cartridges during shipping. Furthermore, additional packaging bulk material creates greater complexity and frustration for the end user to remove the material and dispose of the same.

Accordingly, the need exists for a device and method for minimizing cartridge damage during movement of the cartridge. The device would allow for simple assembly by an individual or machine and disassembly by the end-user. The device would be relatively easy to form and low cost.

SUMMARY OF THE INVENTION

In accordance with one aspect of the invention, a user-removable stabilizer for a toner cartridge assembly is disclosed. The stabilizer may include at least one member that becomes inserted in the toner cartridge assembly for capturing a first movable section of the toner cartridge assembly and interconnecting at least the first movable section with a second movable section of the toner cartridge assembly.

In one embodiment, the stabilizer is keyed to be received by a keyway of the toner cartridge assembly. The at least one member of the stabilizer may include two prongs and the prongs may included inclined faces. The stabilizer may also include a clip that engages the toner cartridge assembly when the stabilizer becomes inserted in the toner cartridge assembly. The stabilizer may also include a cap that engages the toner cartridge assembly when the stabilizer becomes inserted in the toner cartridge assembly.

Also, the stabilizer may include an ejector that assists with expelling the stabilizer in the event a user attempts to insert the toner cartridge assembly into an electrophotographic device when the stabilizer is inserted in the toner cartridge assembly. The stabilizer may include a stop for preventing insertion of the toner cartridge assembly into an electrophotographic device when the stabilizer is inserted in the toner cartridge assembly.

Furthermore, the stabilizer may include at least one tab for facilitating insertion and removal of the stabilizer. In one embodiment, the stabilizer includes a main body portion formed from an elongated beam terminating in the at least one member. The stabilizer may also include a main body portion having a curved surface defining a housing and the at least one member is positioned within the housing.

In accordance with a second aspect of the invention, a toner cartridge assembly is disclosed. The toner cartridge assembly includes a first movable section, a second movable section, a keyway, and a user removable stabilizer including at least one member that is keyed to engage the keyway, wherein the stabilizer interconnects the first and second movable sections. In one embodiment, a portion of the first and second movable sections form the keyway. The stabilizer may include at least two projecting members separated by a gap that form the key to engage the keyway. Also, the at least two projecting members may comprise prongs with inclined faces. The stabilizer may include a stop for preventing insertion of the stabilizer into an electrophotographic device when the stabilizer is inserted in the toner cartridge assembly. The stabilizer may also include an ejector that assists with expelling the stabilizer in the event a user attempts to insert the toner cartridge assembly into an electrophotographic device when the stabilizer is inserted in the toner cartridge assembly. At least one tab may be provided for facilitating insertion and removal of the stabilizer.

In another embodiment, the toner cartridge assembly includes first and second removable stabilizers. Each stabilizer interconnects at least two movable portions of a toner cartridge assembly and at least one of the first and second removable stabilizers includes a stop for preventing insertion of the toner cartridge assembly into an electrophotographic device when the stabilizer is attached to the toner cartridge assembly.

The other of the at least one of the first and second removable stabilizers may have an ejector that assists with expelling the stabilizer in the event a user attempts to insert the toner cartridge assembly into an electrophotographic device when the stabilizer is inserted in the toner cartridge assembly. At least one of the first and second removable stabilizers may include a member that becomes inserted in the toner cartridge assembly for interconnecting the at least two movable sections of the toner cartridge assembly. Also, at least one of the first and second removable stabilizers may be keyed to engage a keyway formed by the at least two movable portions of the toner cartridge assembly. In one embodiment, each of the first and second removable stabilizers include two prongs separated by a gap that form the key to engage the keyway. Also, each of the first and second removable stabilizers may include a clip that engages the toner cartridge assembly and minimizes vertical movement of the stabilizers. Each of the first and second removable stabilizers may also include a tab for facilitating insertion and removal of the stabilizers.

In accordance with a third aspect of the invention, a method of stabilizing movable sections of a toner cartridge assembly is disclosed. The method comprises attaching two stabilizers to the toner cartridge assembly, such that the stabilizers interconnect at least two movable sections of the toner cartridge assembly. In one embodiment, the attaching comprises inserting a member of the first stabilizer in a first end of the toner cartridge assembly and inserting a member of the second stabilizer in a second end of the toner cartridge assembly. The method may also comprise the step of providing an ejector on one of the first and second stabilizers to assist with expelling the stabilizer in the event a user attempts to insert the toner cartridge assembly into an electrophotographic device when the stabilizer is inserted in the toner cartridge assembly. The method may also comprise the step of providing a stop on one of the first and second stabilizers for preventing insertion of the toner cartridge assembly into an electrophotographic device when the stabilizer is attached to the toner cartridge assembly.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE PREFERRED EMBODIMENTS

In the following detailed description of the preferred embodiments, reference is made to the accompanying drawings that form a part hereof, and in which is shown by way of illustrations, specific embodiments in which the invention may be practiced. These embodiments are described in sufficient detail to enable those skilled in the art to practice the invention and like numerals represent like details in the various figures. Also, it is to be understood that other embodiments may be utilized and that process, mechanical and/or other changes may be made without departing from the scope of the present invention. In accordance with the present invention, a stabilizer for a cartridge assembly and related method are hereafter described.

Figure 1A:
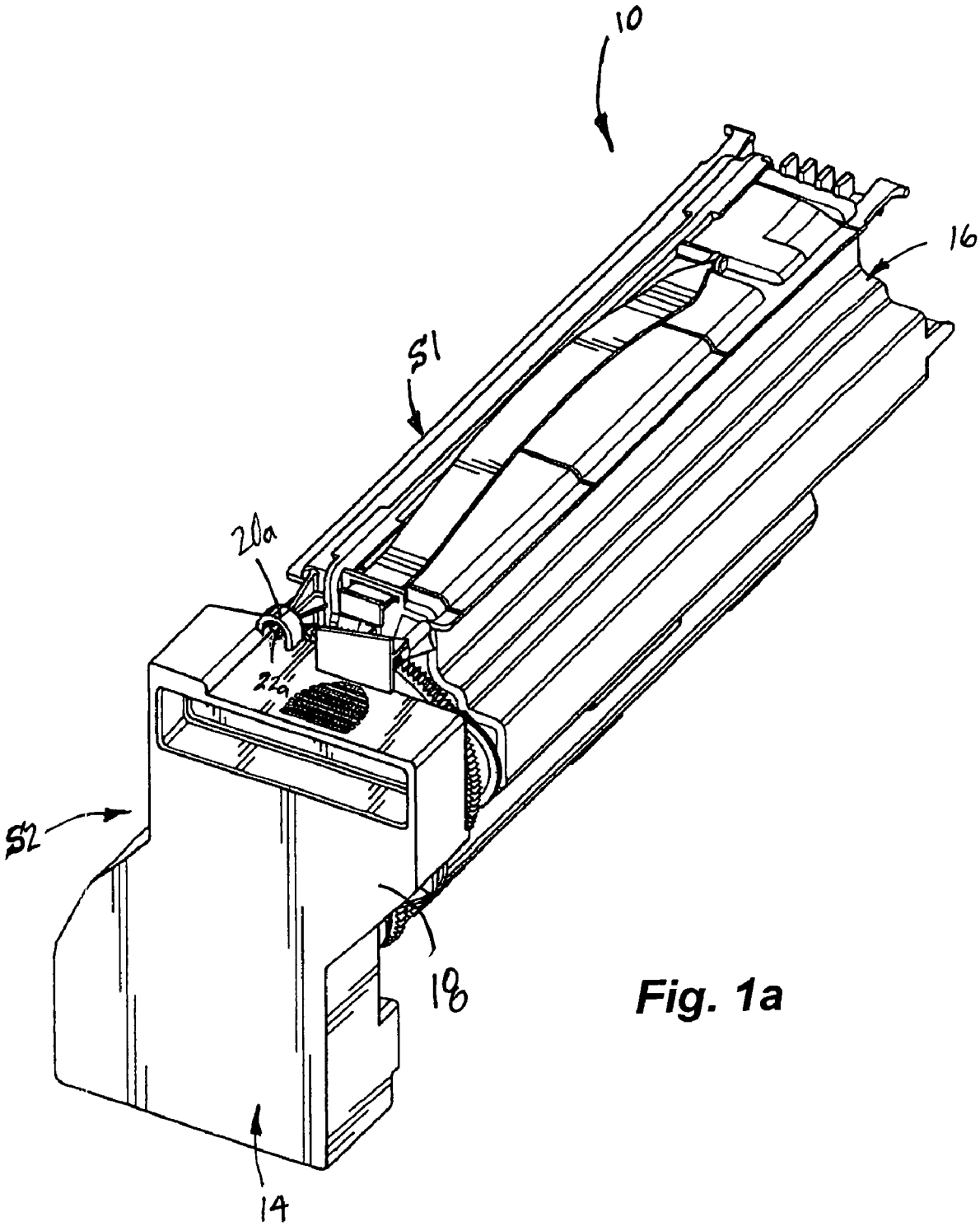
FIG. 1*a* is a perspective view of a representative cartridge assembly in accordance with one possible embodiment of the present invention disclosed herein.
Figure 1B:
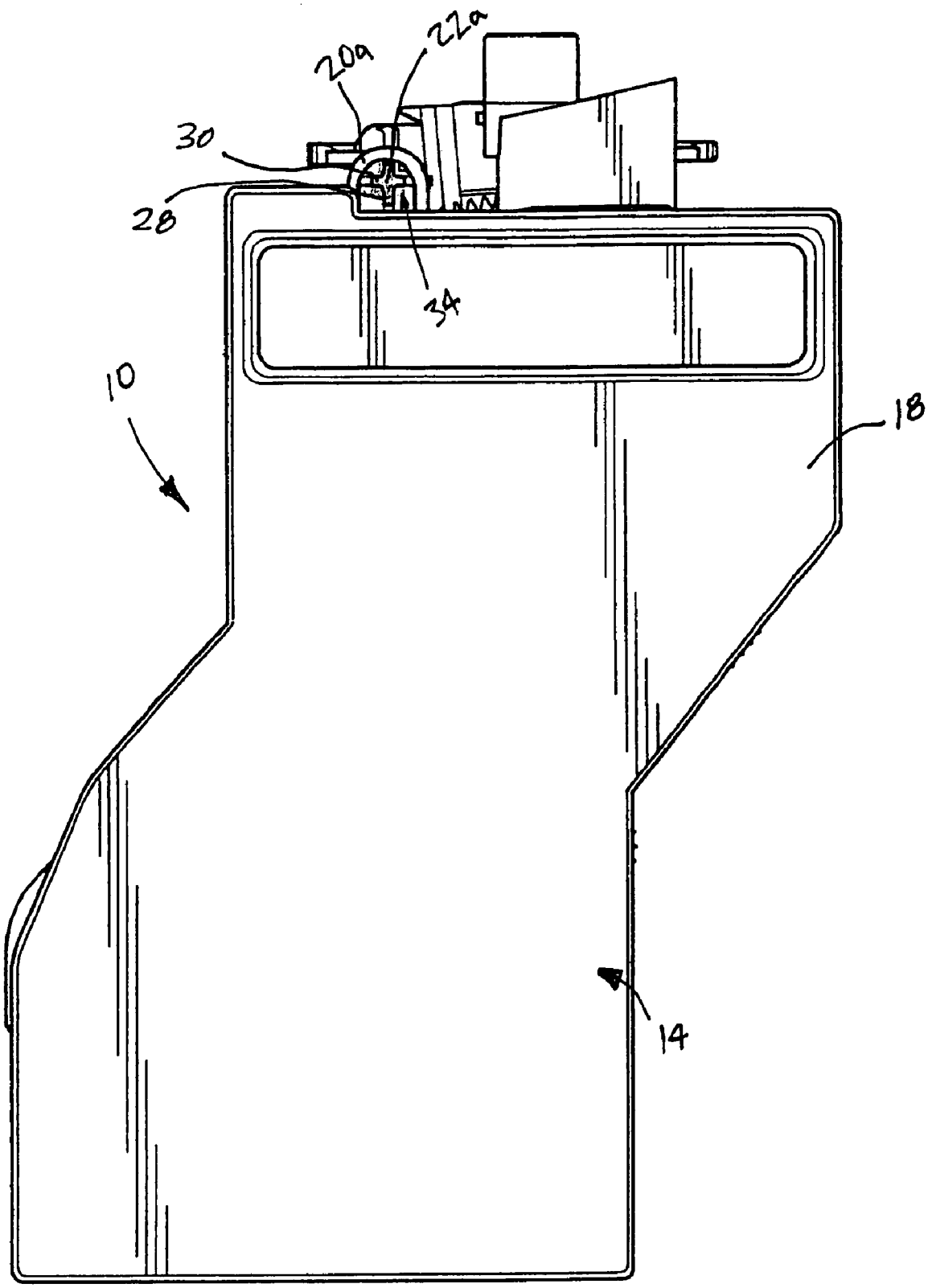
FIG. 1*b* is an elevational view of a cleaner side of the cartridge assembly FIG. 1*a;*
Figure 1C:
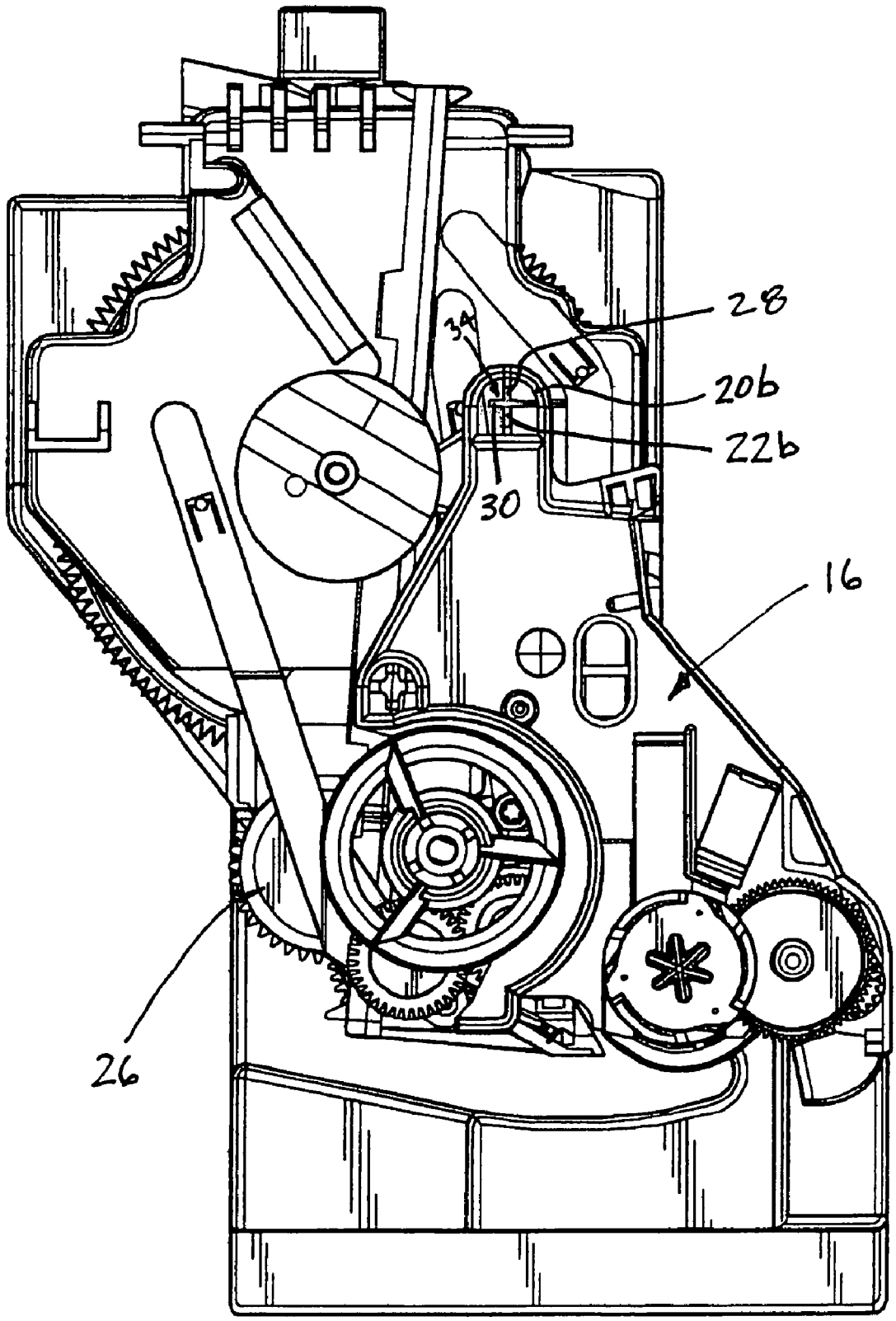
FIG. 1*c* is an elevational view of a drive side of the cartridge assembly of FIG. 1*a;*
Figure 2A:
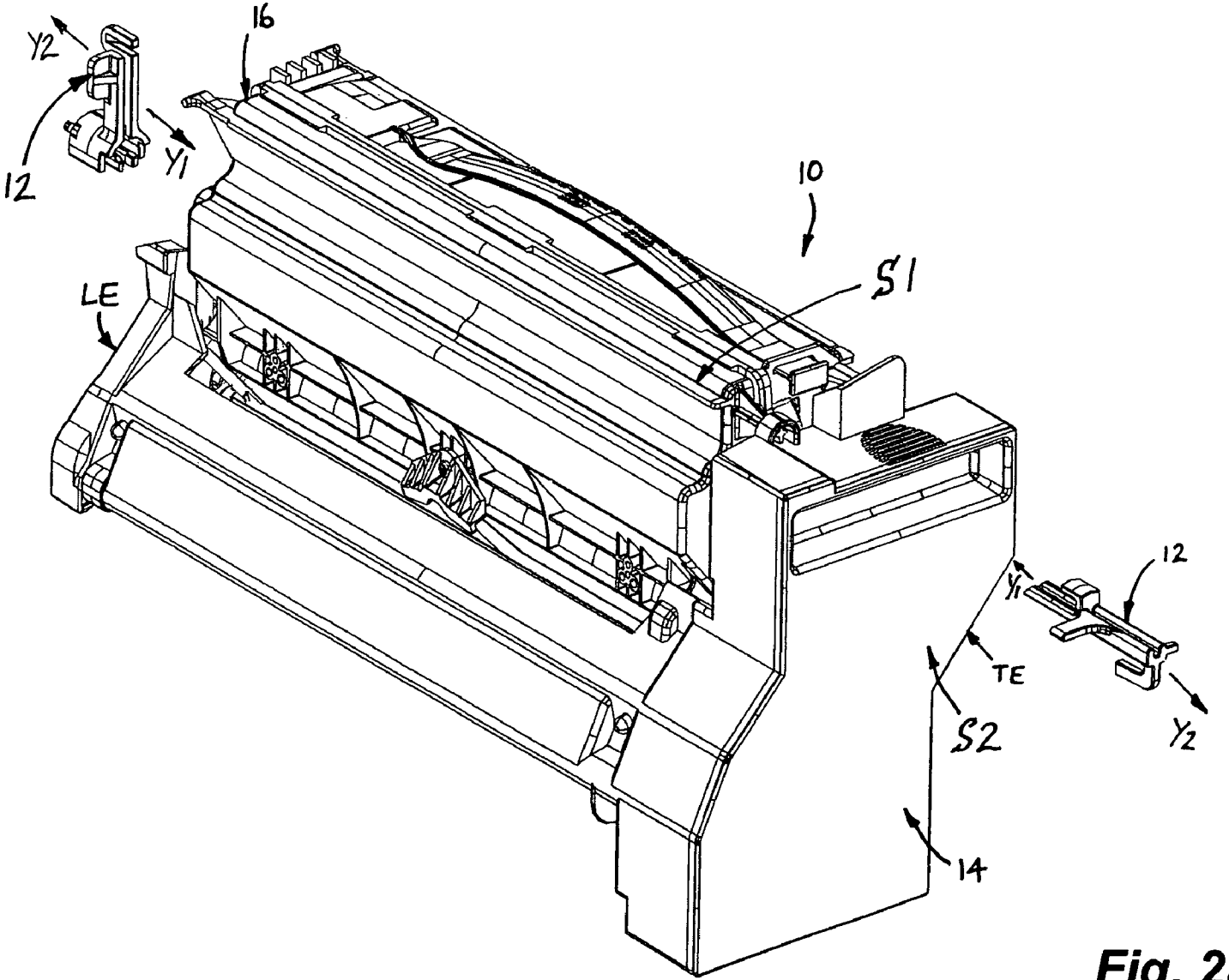
FIGS. 2*a* and 2*b* are perspective views of a toner cartridge assembly showing insertion of a stabilizer of the present invention.
Figure 2B:
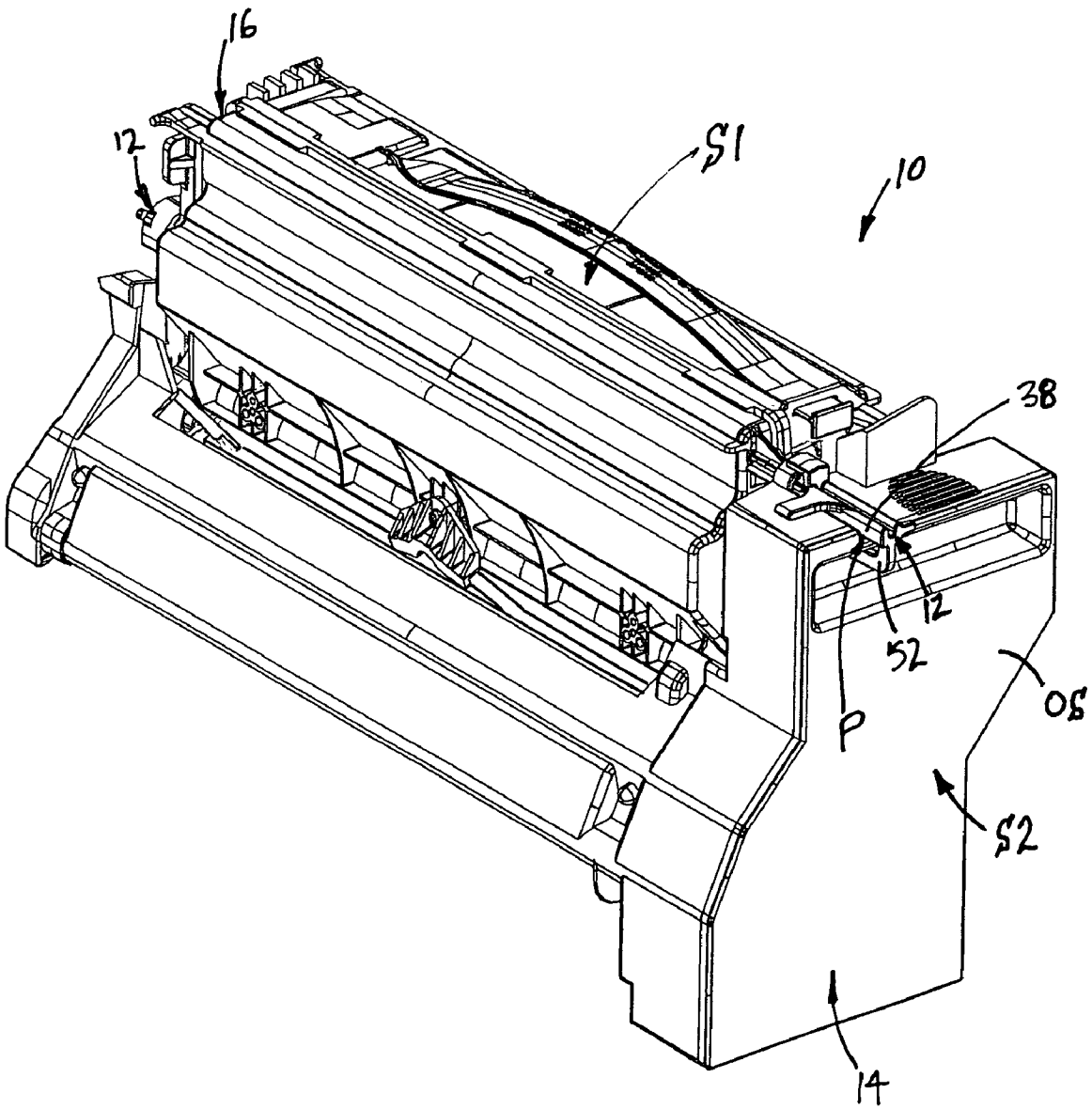

FIGS. 1*a*-1*c* illustrate a representative cartridge assembly, such as a toner cartridge assembly 10 for an electrophotographic image forming device ("EP device") that may utilize one embodiment of the stabilizer of the present invention. As previously mentioned, many of these cartridge assemblies 10 are formed in a multi-part arrangement, wherein at least a first section S1 and second section S2 are movable in relation to one another. For instance, the toner storage component of the assembly may be separable from the image forming housing component. However, other components of the cartridge assembly may be movable in relation to one another. The present invention removably attaches to the cartridge assembly to minimize movement or otherwise stabilize certain movable components of the assembly during transport or other movement of the cartridge assembly. In one embodiment, shown in FIG. 2*a*, the attachment includes inserting at least a portion of the stabilizer 12 into the toner cartridge assembly 10. As shown, the insertion requires the user to direct the stabilizer 12 in the direction Y1 until it engages the toner cartridge assembly 10. FIG. 2*b* shows the stabilizer 12 fully inserted in the toner cartridge assembly.

Further describing the details of the toner cartridge assembly 10, it may include a cleaner side 14 (FIG. 1*b*) and a drive side 16 (FIG. 1*c*). The cleaner side 14 may include a housing 18 that receives waste toner. As shown, the housing 18 includes a receiver 20*a* that receives a projection or post 22*a* from a first section S1 of the toner cartridge assembly 10. The first section S1 may comprise the toner storage component of the cartridge assembly 10.

Turning to FIG. 1*c*, the drive side 16 includes a gear assembly 26 that facilitates part of the image transfer process for the EP device. This process of image forming is well known and not discussed further herein. Similar to the housing 18 of the cleaner side 14, the drive side 16 includes a receiver 20*b* that receives a projection or post 22*b* from the first section S1 of the toner cartridge assembly 10. The post 22*b* may move within the receiver 20*b*, which provides a certain freedom of the cartridge components that may be desirable after the cartridge assembly 10 becomes installed in the EP device or when separating sections of a multi-part cartridge assembly 10.

In one embodiment, the posts 22*a*, 22*b* have a vertical member 28 crossed with a horizontal member 30, thereby substantially forming a "t-shape." The receivers shown have a substantially arched surface that receives the t-shaped post 22*a*, 22*b*. The combination of the posts 22*a*, 22*b* and the receivers 20*a*, 20*b* create a keyway 34 for receiving a keyed portion of the stabilizer 12, as discussed below in further detail. As previously discussed in the Background, during movement of the toner cartridge assembly (such as during shipping), the post 22*a*, 22*b* and its connected structure may deleteriously move in relation to the receiver and its connected structure. This may result in fracture of a component of the cartridge assembly 10, thereby rendering the cartridge unusable. However, as previously mentioned, movement of the post 22*a*, 22*b* within the receiver 20*a*, 20*b*, may be desirable after the cartridge assembly 10 becomes installed in the EP device or when separating sections of a multi-part cartridge assembly 10. The stabilizer 12 of the present invention serves to stabilize or minimize movement of sections (e.g., S1, S2) of the cartridge assembly 10 during movement (such as during shipping of the cartridge assembly 10), but is removable to allow desired movement of the sections S1, S2 after movement of the cartridge assembly 10.

Figure 3A:
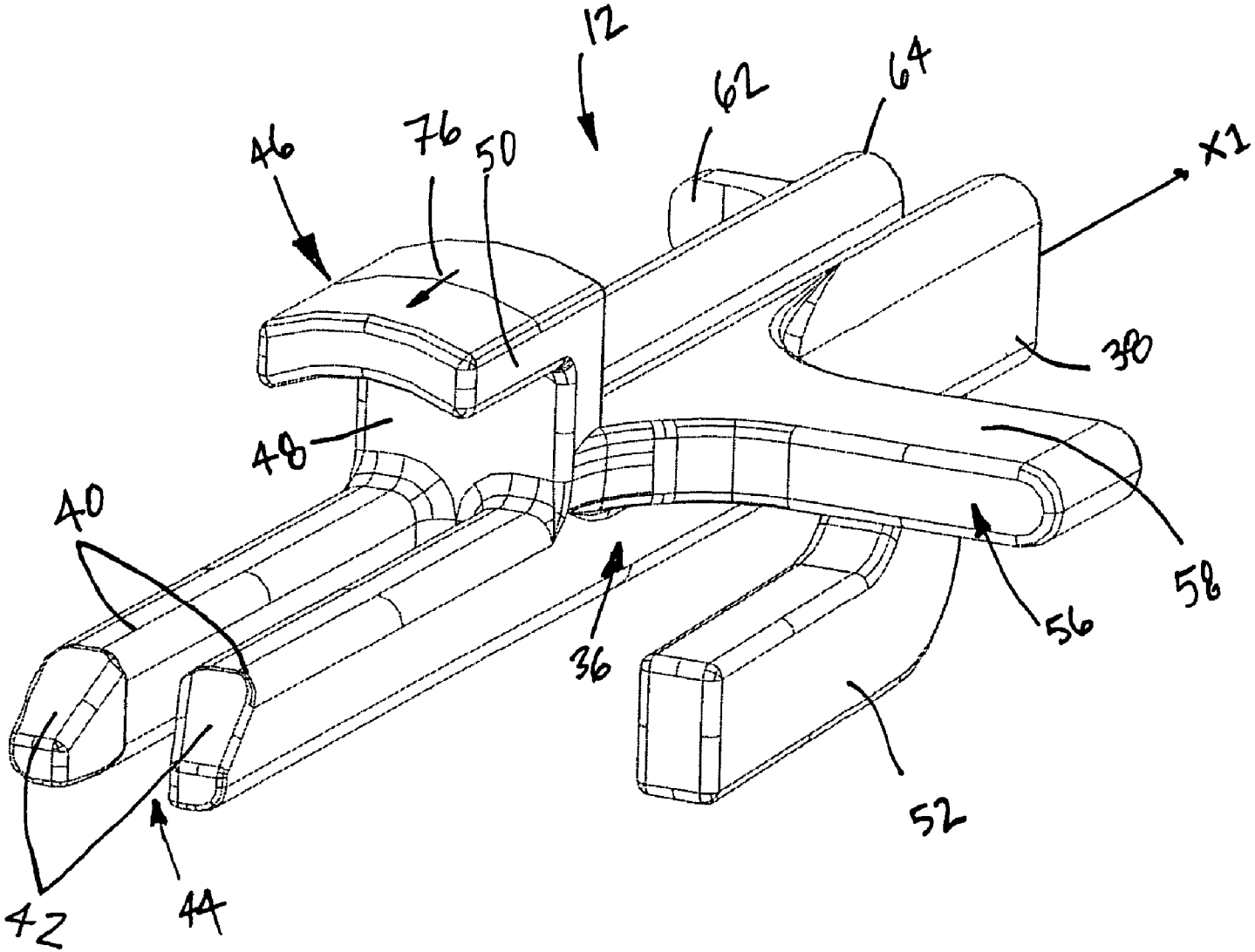
FIGS. 3*a* and 3*b* are perspective views a first embodiment of a stabilizer of the present invention.
Figure 3B:
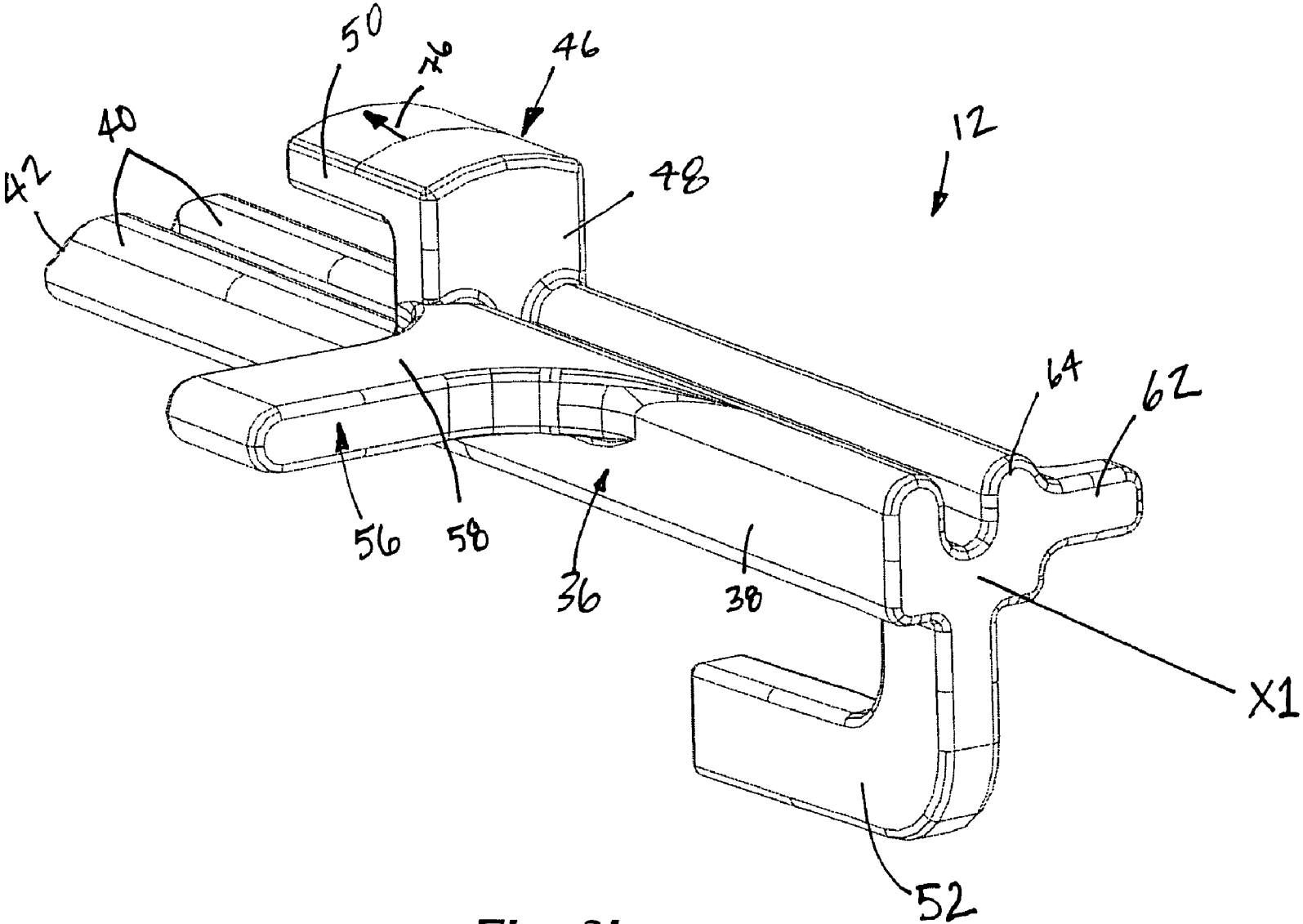

In a first embodiment shown in FIGS. 3*a* and 3*b*, the stabilizer 12 includes a main body portion 36 formed from an elongated beam 38 having a longitudinal axis X1. One end of the beam 38 terminates in at least one projecting member, such as the prongs 40 shown. The prongs 40 include inclined faces 42 that assist with installation of the stabilizer 12. For instance, the inclined faces 42 form a ramp that initially loosely engages the post 22*a*, 22*b* and transitions to a tighter fit as the user further inserts the stabilizer 12. Although two prongs 40 with inclined faces 42 are shown, the stabilizer 12 may include one or any number of projecting member(s) with any profile. Also, the prongs 40 may be any length, but would preferably have a length L1 in the direction of the axis X1 less than or equal to a length L2 of the post 22*a*, 22*b* (see FIG. 1*a*). Preferably, the projecting member(s) would be "keyed," such that they would permit insertion into the keyway 34 formed by the posts 20*a*, 20*b* and receivers 18*a*, 18*b*. For instance, a gap 44 separates the two prongs 40 shown in FIG. 3*a*, such that insertion of the stabilizer 12 results in the vertical member 26 of the t-shaped post 20*a*, 20*b* becoming positioned in the gap 44 between the prongs 40. Capturing the vertical member 26 helps to minimize rotational and vertical movement of the post within the receiver 18*a*, 18*b*.

At the junction of the prongs 40 and the main body portion 36, the stabilizer 12 includes a cap 46. As shown, a vertical wall 48 and horizontal wall 50 form the cap 46, such that it extends at least partially over the prongs 40. The vertical wall 48 provides a stop for limiting the distance the stabilizer may become inserted in the cartridge assembly 10, while the horizontal wall 50 assists with minimizing vertical movement and rotation of the stabilizer when installed. In other words, as the user inserts the prongs 40 into a portion of the cartridge assembly 10, the vertical wall 48 engages a portion of the cartridge assembly 10 and prevents further insertion, as seen in FIG. 2*b*. Preferably, the cap 46 contacts a portion of the cartridge assembly 10, which further limits vertical movement of the stabilizer 12 with relation to the cartridge assembly 10. Although described as being positioned at the junction of the prongs 40 and the main body portion 36, the cap 46 may be positioned anywhere on the stabilizer 12.

The end of the beam 38, opposite the at least one projecting member, includes a clip 52. The clip 52 may comprise various structures that serve to further engage the cartridge assembly 10 when installed. In the present embodiment, the clip 52 has a curved member projecting from the beam 38, thereby forming a hook. As shown in FIG. 2*b*, the clip 52 captures a portion P of the cartridge assembly 10. This capturing assists with minimizing vertical movement of the stabilizer 12 because the portion P of the cartridge assembly 10 becomes substantially fixed within the clip 52.

Once inserted (FIG. 2*b*), the stabilizer interconnects the first section S1 and second section S2 of the cartridge assembly 10 having one of the posts 22*a*, 22*b* and one of the receivers 20*a*, 20*b*. This interconnection minimizes relative movement, such as any vertical, horizontal, rotational, or other movement, of the sections S1, S2 with relation to each other. During movement of the cartridge assembly 10, such as during shipping, the interconnection of the sections S1 and S2 prevents either section from moving in a manner that would result in fracture. Instead, the stabilizer 12 substantially rigidly holds the sections S1 and S2 together, thus minimizing damage to the cartridge assembly 10. One will appreciate that this embodiment of the stabilizer has a substantially horizontal configuration when inserted in the cartridge assembly 10. Also, a portion of the stabilizer 12, such as a portion of the clip 52 or the main body portion 36, may extend beyond the boundary of the cartridge assembly 10 when inserted. For instance, as shown in FIG. 2*b*, a portion of the stabilizer 12 extends beyond an outer surface OS of the cleaner side 14. Alternatively, the stabilizer 12 may be substantially flush with the cartridge assembly 10 or fully recessed within the boundary of the cartridge assembly 10 when inserted.

Figure 4:
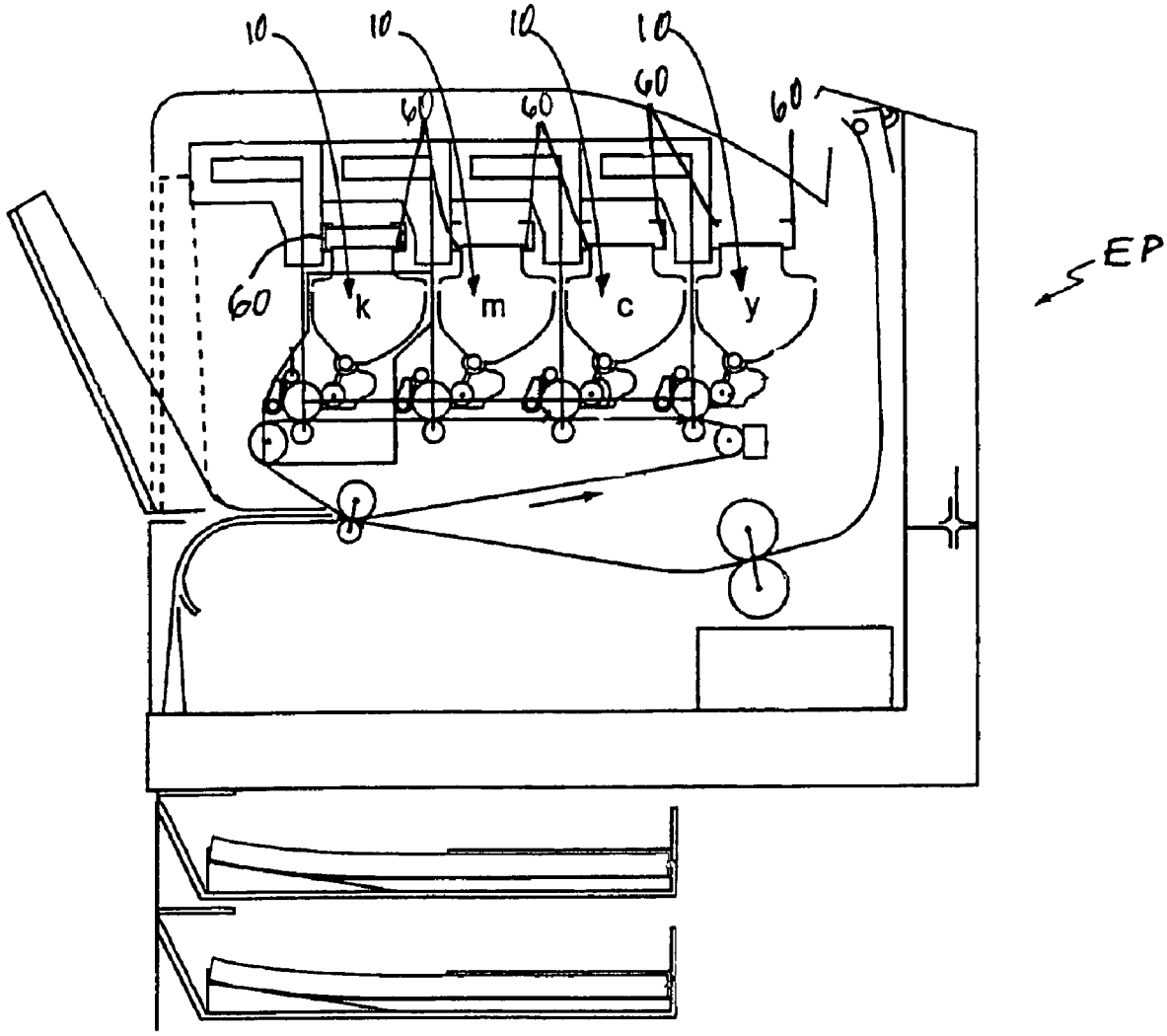
FIG. 4 is a cutaway side view of a representative electrophotographic image forming device of the present invention.

It is intended that the user would remove the stabilizer 12 from the cartridge assembly 10 prior to insertion of the cartridge assembly 10 into the EP device. This removal may be accomplished by simply pulling a part of the stabilizer 12 in a direction Y2 (FIG. 2*a*) away from the cartridge assembly 10. However, the stabilizer 12 may also include an ejector 56 or other structure that expels the stabilizer 12 from the cartridge assembly 10 in the event a user attempts to insert the toner cartridge assembly 10 into the EP device with the stabilizer still attached. In other words, the ejector 56 comprises an elongated member 58 extending substantially transverse to the longitudinal axis X1 of the beam. In this arrangement, as a user inserts the cartridge assembly 10 with the stabilizer 12 of the present embodiment into the EP device, a portion of the EP device, such as a support rail 60 (FIG. 4), may engage the ejector 56. As the user continues to insert the cartridge assembly 10, the support rail 60 prevents insertion of the stabilizer 12 and expels the stabilizer 12 from the cartridge assembly 10. Although shown in this embodiment as being positioned adjacent to the cap, the ejector may be located anywhere on the stabilizer 12 to force a situation that causes the stabilizer 12 to become expelled when it engages a structure on the EP device.

To facilitate insertion and/or removal of the stabilizer 12 into and out of the cartridge assembly 10, the stabilizer 12 may include one or more tabs 62. The tab 62 provides a point for the user to engage with his or her fingers to remove the stabilizer by pulling in the direction of the longitudinal axis X1. Although the tab 62 may be positioned anywhere on the stabilizer 12, it would preferably be located at a point easily accessible by the user when the stabilizer 12 is inserted in the cartridge assembly 10. As shown, this may result in the tab 62 being positioned near an edge 64 of the stabilizer 12.

Figure 5A:
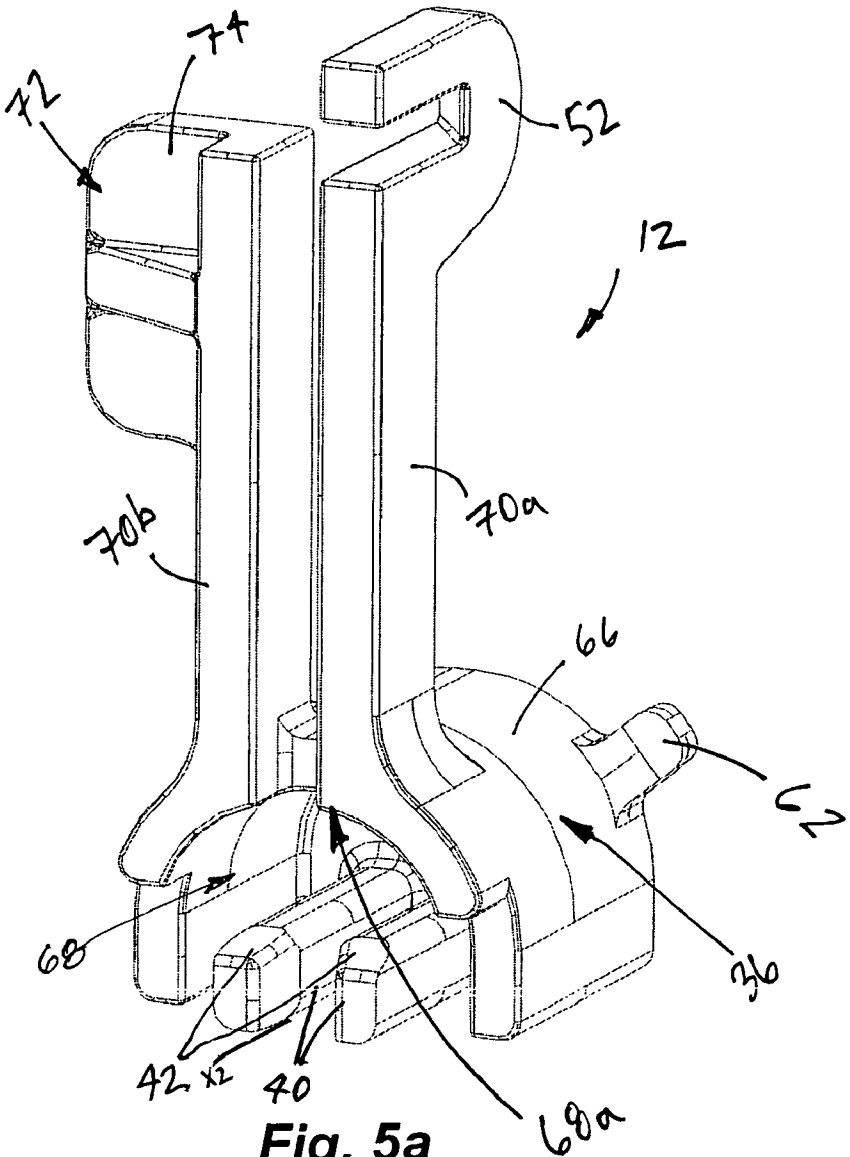
FIGS. 5*a* and 5*b* are perspective views of a second embodiment of a stabilizer of the present invention.
Figure 5B:
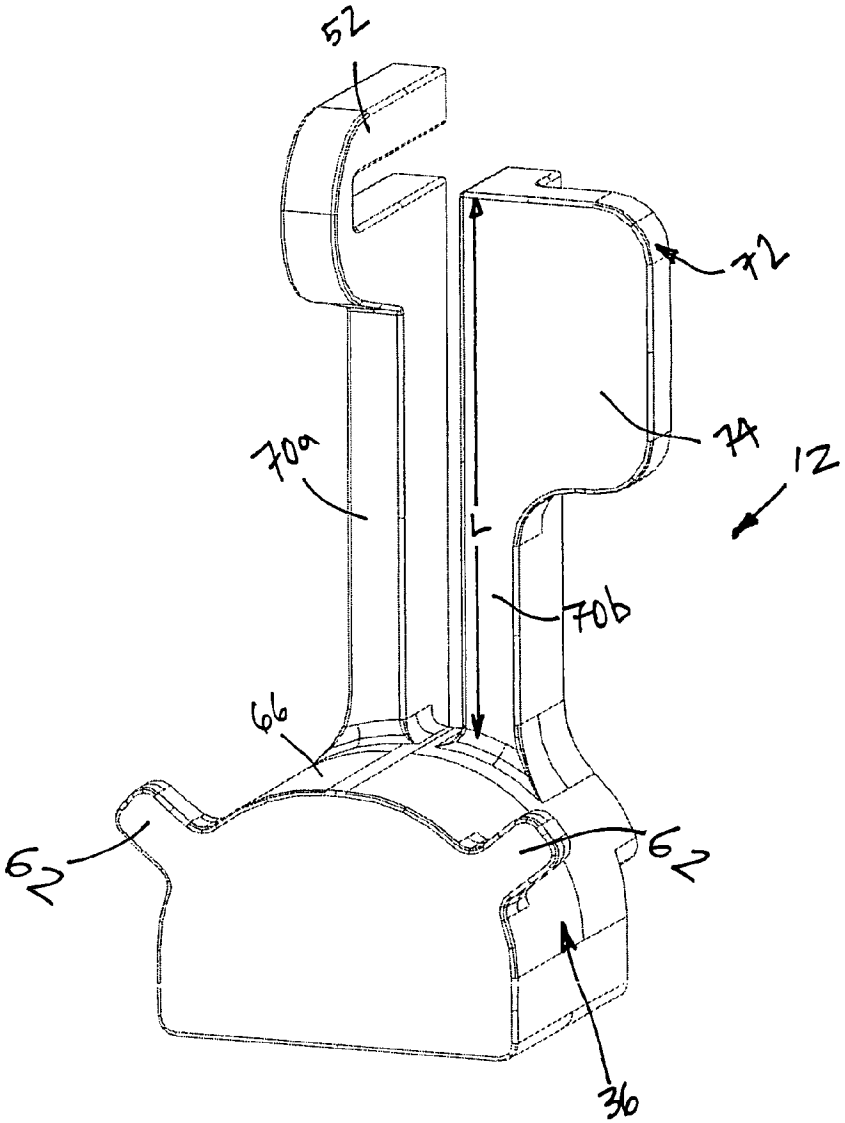

FIGS. 5*a* and 5*b* illustrate a second embodiment of the stabilizer 12. Instead of the substantially horizontal installed configuration of the first embodiment, this embodiment has a substantially vertical configuration when installed. As shown, the main body portion 36 includes a curved surface 66 defining a housing 68. In one embodiment, the housing 68 includes an archway 68*a* having a profile similar to a profile of the arched surface of the receivers 20*a*,20*b*. These similar profiles enable the archway 68*a* to become positioned over the arched surface of the receivers 20*a*, 20*b*. Within the housing 68, the stabilizer 12 includes at least one projecting member, such as the prongs 40 previously discussed. Again, while two prongs 40 with inclined faces 42 are shown, the stabilizer 12 may include one or any number of projecting member(s) with any profile.

With specific reference to FIG. 5*a*, the stabilizer 12 may also include one or more projecting member(s) 70*a*, 70*b* extending in a vertical direction, substantially transverse to a longitudinal axis X2 of the prongs 40. As shown, the stabilizer 12 includes two substantially parallel, vertical projecting members 70*a*, 70*b* extending from the top of the curved surface 66 of the main body 36. In this arrangement, one of the vertical projecting members 70*a*, 70*b* includes a second embodiment of the clip 52. In the present embodiment, the clip 52 has a curved member projecting from the vertical projecting member 70*a*, thereby forming a hook. As previously discussed, the clip 52 minimizes vertical movement of the stabilizer 12 when installed.

The other of the vertical projecting members 70*b* includes a stop 72 for preventing insertion of the stabilizer 12 into the EP device and thereby informing the user to remove the stabilizer 12. In one embodiment, the stop 72 takes the form of a wall 74 extending from a portion of the projecting member 70*b*. Although the wall 74 may have any dimensions, as shown, it extends approximately half the length L of the vertical projecting member 70*b*. If a user attempts to insert a cartridge assembly 10 into EP device with the present embodiment of the stabilizer 12 installed, the wall 74 will engage a portion of the EP device. For instance, the support rail 60 (FIG. 4) or other structure may engage the wall 74, thereby providing resistance as the user attempts to insert the cartridge assembly. Noting this resistance, the user will remove the stabilizer 12, thereby permitting easy installation of the cartridge assembly. The stabilizer 12 may have one or more tabs 62 to facilitate with the removal of the stabilizer 12. As previously discussed, the tabs 62 provide a point for the user to engage with his or her fingers to remove the stabilizer by pulling in the direction of the axis X2. In the present embodiment, the stabilizer 12 includes two tabs 62 symmetrically positioned on the curved surface 66 defining the housing 68.

Although a cartridge assembly 10 may only have a single stabilizer 12, multiple stabilizers 12 may simultaneously be used. For instance, a stabilizer 12 having a stop 72 may become inserted into a leading edge LE (FIG. 2) of the cartridge assembly 10 (i.e., the edge that would be the first inserted into the EP device), while a stabilizer 12 having an ejector 56 may become inserted into an opposite or trailing edge TE of the cartridge assembly 10. Obviously, utilizing two or more stabilizers 12 enables a user to interconnect multiple sides of the cartridge sections S1 and S2, thereby further minimizing movement versus use of a single stabilizer alone.

The present invention presents a stabilizer 12 for a toner cartridge assembly 10 that minimizes movement of cartridge sections S1, S2, thereby minimizing cartridge 10 damage during movement of the cartridge 10. The stabilizer 12 allows for simple attachment and removal from the cartridge assembly 10.

The foregoing discussion was chosen to provide the best illustration of the principles of the invention and its practical application to thereby enable one of ordinary skill in the art to utilize the invention in various embodiments and with various modifications suited to the particular use contemplated. Instead of the one-piece stabilizers 12 disclosed, the stabilizer may be multiple pieces. The stabilizer 12 may be formed from casting, welding, or otherwise. Preferably, the stabilizer 12 would be formed from a polymer material, such as acrylonitrile butadiene styrene (ABS), polypropylene, or other. Also, the stabilizers 12 would preferably be formed from a bright color, such as red, to capture the user's attention. In one embodiment, the stabilizer 12 is at least partially in a color different than the color of the first and second movable sections S1, S2. For instance, the stabilizer may be partially or fully the color red, while the first and second movable sections S1, S2 are black or gray. The stabilizer 12 may be formed in this color (e.g., by molding) or color maybe added to a formed stabilizer 12. Alternatively, or in addition to the bright color, the stabilizer 12 may also have a sticker or removable "flag" to attract the user's attention and remind the user to remove the stabilizer 12 prior to insertion of the cartridge assembly 10 into the EP device. Instead of the sticker or removable flag, the stabilizer 12 may be formed with a permanent directional symbol, such as an arrow 76 indicating a direction for insertion and/or removal of the stabilizer 12. Although the term "cartridge assembly" or "toner cartridge assembly" are used throughout this specification, a skilled artisan will appreciate that the stabilizer may be used with any supply item of an EP device. All modifications and variations are within the scope of the invention as determined by the appended claims when interpreted in accordance with the breadth to which they are fairly, legally and equitably entitled.

What is claimed:

1. A user-removable stabilizer for a toner cartridge assembly, comprising:

an elongated shaft having a first end portion and a second end portion;

at least one member that becomes inserted in the toner cartridge assembly for capturing a first movable section of the toner cartridge assembly and interconnecting at least the first movable section with a second movable section of the toner cartridge assembly, comprising at least two prongs disposed substantially in parallel with each other and extending from the first end portion of the elongated shaft; and a clip member disposed along the second end portion of the elongated shaft for engaging with at least one of the first movable section and the second movable section when the stabilizer is inserted in the toner cartridge assembly.

2. The user-removable stabilizer of claim 1, wherein the stabilizer is keyed to be received by a keyway of the toner cartridge assembly.

3. The user-removable stabilizer of claim 1, wherein the two prongs include inclined faces.

4. The stabilizer of claim 1, wherein the stabilizer includes a cap that engages the toner cartridge assembly when the stabilizer becomes inserted in the toner cartridge assembly.

5. The stabilizer of claim 1, wherein the stabilizer includes an ejector that extends from the elongated shaft in a direction substantially orthogonal from a direction from which the at least two prongs extend, and assists with expelling the stabilizer in the event a user attempts to insert the toner cartridge assembly into an electrophotographic device when the stabilizer is inserted in the toner cartridge assembly.

6. The stabilizer of claim 1, wherein the stabilizer includes a stop for preventing insertion of the toner cartridge assembly into an electrophotographic device when the stabilizer is inserted in the toner cartridge assembly.

7. The stabilizer of claim 1, wherein the stabilizer includes at least one tab for facilitating insertion and removal of the stabilizer.

8. The stabilizer of claim 1, wherein the stabilizer includes a main body portion having a curved surface formed at the first end portion of the elongated shaft defining a housing, the housing defining a volume from which distal ends of the at least two prongs extend.

9. A toner cartridge assembly, comprising:

a first movable section;

a second movable section;

a keyway formed by a portion of the first and second movable sections;

a user removable stabilizer including an elongated shaft, at least one member that is keyed to engage the keyway, wherein the stabilizer interconnects the first and second movable sections, the at least one member comprising at least two prongs disposed in substantially parallel relation to each other and extending from a first end portion of the elongated shaft.

10. The toner cartridge assembly of claim 9, wherein the keyway includes a curved portion extending from the first movable section and at least one post extending from the second movable section, the at least one post being removably inserted with the curved portion.

11. The toner cartridge assembly of claim 10, wherein the at least two prongs are separated by a gap that form the key to engage the curved portion and the at least one post of the keyway when inserted therein.

12. The toner cartridge assembly of claim 11, wherein the at least two prongs include inclined faces along distal ends thereof.

13. The toner cartridge assembly of claim 11, wherein the stabilizer includes a stop for preventing insertion of the stabilizer into an electrophotographic device when the stabilizer is inserted in the toner cartridge assembly.

14. The toner cartridge assembly of claim 11, wherein the stabilizer includes an ejector that assists with expelling the stabilizer in the event a user attempts to insert the toner cartridge assembly into an electrophotographic device when the stabilizer is inserted in the toner cartridge assembly.

15. The toner cartridge assembly of claim 9, wherein the stabilizer includes a clip member disposed at a second end portion of the elongated shaft which selectively engages with at least one of the first movable section and the second movable section when the stabilizer interconnects the first and second movable sections.

16. A toner cartridge assembly, comprising:

at least two movable cartridge portions that are removably disconnected to each other, the at least two cartridge portions defining first and second keyways, each keyway including a curved portion defined along a first of the at least two cartridge portions and at least one post extending from a second of the at least two cartridge portions and removably inserted in a curved portion;

first and second removable stabilizers, each stabilizer being selectively inserted into a keyway which substantially stably interconnects the at least two movable cartridge portions of a toner cartridge assembly, wherein at least one of the first and second removable stabilizers includes a stop for preventing insertion of the toner cartridge assembly into an electrophotographic device when the stabilizer is attached to the toner cartridge assembly.

17. The toner cartridge assembly of claim 16, wherein the other of the at least one of the first and second removable stabilizers includes an ejector that assists with expelling the stabilizer in the event a user attempts to insert the toner cartridge assembly into an electrophotographic device when the stabilizer is inserted in the toner cartridge assembly.

18. The toner cartridge assembly of claim 16, wherein each of the first and second removable stabilizers includes a plurality of prong members disposed substantially in parallel with each other that are selectively inserted in each keyway for interconnecting the at least two cartridge portions of the toner cartridge assembly.

19. The toner cartridge assembly of claim 18, wherein at least one of the first and second removable stabilizers includes an elongated shaft and a curved housing portion disposed alone the elongated shaft relative to the prong members such that the housing portion is positioned outside of the curved portion of the keyway when the at least one stabilizer is inserted in the keyway.

20. The toner cartridge assembly of claim 19, wherein each of the first and second removable stabilizers includes a clip disposed along the elongated shaft and that engages the toner cartridge assembly and minimizes vertical movement of the stabilizers.

21. The toner cartridge assembly of claim 20, wherein each of the first and second removable stabilizers includes a tab for facilitating insertion and removal of the stabilizers.

22. The toner cartridge assembly of claim 16, wherein at least one of the first and second removable stabilizers is at least partially in a color different than the color of the first and second movable cartridge portions.

23. The toner cartridge assembly of claim 16, wherein at least one of the first and second removable stabilizers includes a direction symbol indicating a direction of insertion or removal of the stabilizer.

24. A method of stabilizing movable sections of a toner cartridge assembly, comprising:

interconnecting together at least two movable sections of the toner cartridge assembly by inserting posts of a first movable section into substantially semi-circular portions of a second movable section so as to form at least two keyways therebetween; and attaching two stabilizers to the toner cartridge assembly by inserting a portion of each stabilizer into a distinct keyway, such that the stabilizers interconnect at least two movable sections of the toner cartridge assembly.

25. The method of claim 24, wherein the inserting comprises inserting a member of the first stabilizer in a first end of the toner cartridge assembly and inserting a member of the second stabilizer in a second end of the toner cartridge assembly.

26. The method of claim 24, further comprising the step of providing an ejector on one of the first and second stabilizers to assist with expelling the stabilizer in the event a user attempts to insert the toner cartridge assembly into an electrophotographic device when the stabilizer is inserted in the toner cartridge assembly.

27. The method of claim 24, further comprising clipping each stabilizer to the toner cartridge assembly when the stabilizer is inserted into the keyway.

* * * * *